US010696915B2

(12) United States Patent
Arriaga et al.

(10) Patent No.: US 10,696,915 B2
(45) Date of Patent: Jun. 30, 2020

(54) DRY LUBRICATOR FOR PLASTIC AND STAINLESS STEEL SURFACES

(71) Applicant: Ecolab USA Inc., Saint Paul, MN (US)

(72) Inventors: Fabiola Morales Arriaga, Guadalupe N.L. (MX); Sara Trevino Garza, Santiago N.L. (MX); Jesus Ochoa Guerra, Nuevo Leon C.P. (MX); Jaime Mendoza Santos, Nuevo Leon, C.P. (MX)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 14/809,437

(22) Filed: Jul. 27, 2015

(65) Prior Publication Data

US 2017/0029736 A1 Feb. 2, 2017

(51) Int. Cl.
*C10M 169/04* (2006.01)
*C10M 129/76* (2006.01)
(Continued)

(52) U.S. Cl.
CPC ..... *C10M 129/76* (2013.01); *C10M 111/02* (2013.01); *C10M 111/04* (2013.01);
(Continued)

(58) Field of Classification Search
CPC ..... C10M 169/04; C10M 173/025; C10M 101/00; C10M 105/00; C10M 129/76; C10M 111/02; C10M 111/04; C10M 2207/283; C10M 2209/108; C10M 2207/2895; C10M 2203/10; C10M 2209/109; C10M 2207/122; C10M 2207/126; C10M 2209/104; C10M 2203/1006; C10M 2209/105; C10N 2270/02; C10N 2250/04; C10N 2250/10; C10N 2240/52; C10N 2230/06
See application file for complete search history.

(56) References Cited

U.S. PATENT DOCUMENTS 3,860,521 A * 1/1975 Aepli ..... C02F 9/005 508/438
5,062,979 A 11/1991 Scharf et al.
(Continued)

FOREIGN PATENT DOCUMENTS

JP 11209773 8/1999
JP 2011518896 A 6/2011
(Continued)

OTHER PUBLICATIONS

Ecolab Usa Inc., PCT/US2016/043998 filed Jul. 26, 2016, "The International Search Report and the Written Opinion of the International Searching Authority", dated Sep. 29, 2016, 11 pages.

*Primary Examiner* — Taiwo Oladapo
(74) *Attorney, Agent, or Firm* — McKee, Voorhees & Sease, PLC

(57) ABSTRACT

A dry lubricant for conveyor belts and other surfaces set for lubricating through direct application via a nozzle is disclosed. Lubricants including a homogeneous mixture of fatty acids, a hydrocarbon such as a mineral oil, a sorbitan ester, and a polyglycol, which are substantially-free of water are disclosed. Methods of using the lubricants in dry and semi-dry modes are further disclosed.

16 Claims, 8 Drawing Sheets

(51) Int. Cl.

| | |
|---|---|
| ***C10M 111/04*** | (2006.01) |
| ***C10M 111/02*** | (2006.01) |
| ***C10M 173/02*** | (2006.01) |
| *C10M 101/00* | (2006.01) |
| *C10M 105/00* | (2006.01) |

(52) U.S. Cl.

CPC ..... *C10M 169/04* (2013.01); *C10M 173/025* (2013.01); *C10M 101/00* (2013.01); *C10M 105/00* (2013.01); *C10M 2203/10* (2013.01); *C10M 2203/1006* (2013.01); *C10M 2207/122* (2013.01); *C10M 2207/126* (2013.01); *C10M 2207/283* (2013.01); *C10M 2207/2895* (2013.01); *C10M 2209/104* (2013.01); *C10M 2209/105* (2013.01); *C10M 2209/108* (2013.01); *C10M 2209/109* (2013.01); *C10N 2230/06* (2013.01); *C10N 2240/52* (2013.01); *C10N 2250/04* (2013.01); *C10N 2250/10* (2013.01); *C10N 2270/02* (2013.01)

(56) References Cited

U.S. PATENT DOCUMENTS

| | | | |
|---|---|---|---|
| 5,174,914 | A | 12/1992 | Gutzmann |
| 5,182,035 | A | 1/1993 | Schmidt et al. |
| 5,244,589 | A | 9/1993 | Liu et al. |
| 5,352,376 | A | 10/1994 | Gutzmann |
| 5,559,087 | A | 9/1996 | Halsrud et al. |
| 5,863,874 | A | 1/1999 | Person Hei et al. |
| 5,925,601 | A | 7/1999 | McSherry et al. |
| 5,932,526 | A | 8/1999 | Person Hei et al. |
| 6,207,622 | B1 | 3/2001 | Li et al. |
| 6,288,012 | B1 | 9/2001 | Li et al. |
| 6,310,013 | B1 | 10/2001 | Lokkesmoe et al. |
| 6,372,698 | B1 | 4/2002 | Strothoff et al. |
| 6,475,961 | B2 | 11/2002 | Lokkesmoe et al. |
| 6,495,494 | B1 | 12/2002 | Li et al. |
| 6,509,302 | B2 | 1/2003 | Li et al. |
| 6,525,005 | B1 | 2/2003 | Kravitz et al. |
| 6,576,298 | B2 | 6/2003 | Bennett et al. |
| 6,591,970 | B2 | 7/2003 | Olson et al. |
| 6,667,283 | B2 | 12/2003 | Kravitz et al. |
| 6,673,753 | B2 | 1/2004 | Person Hei et al. |
| 6,688,434 | B2 | 2/2004 | Johnson et al. |
| 6,743,758 | B2 | 6/2004 | Li et al. |
| 6,756,347 | B1 | 6/2004 | Besse et al. |
| 6,806,240 | B1 | 10/2004 | Hei et al. |
| 6,821,568 | B2 | 11/2004 | Bennett et al. |
| 6,855,676 | B2 | 2/2005 | Li et al. |
| 6,967,189 | B2 | 11/2005 | Li et al. |
| 7,067,182 | B2 | 6/2006 | Li et al. |
| 7,109,152 | B1 | 9/2006 | Corby et al. |
| 7,125,827 | B2 | 10/2006 | Li et al. |
| 7,297,666 | B2 | 11/2007 | Kupper et al. |
| 7,371,711 | B2 | 5/2008 | Li et al. |
| 7,371,712 | B2 | 5/2008 | Li et al. |
| 7,384,895 | B2 | 6/2008 | Person Hei et al. |
| 7,462,584 | B2 | 12/2008 | Kupper et al. |
| 7,727,941 | B2 | 6/2010 | Morrison et al. |
| 7,741,257 | B2 | 6/2010 | Valencia Sil et al. |
| 7,745,381 | B2 | 6/2010 | Valencia Sil et al. |
| 7,820,603 | B2 | 10/2010 | Court et al. |
| 7,915,206 | B2 | 3/2011 | Morrison et al. |
| 8,058,215 | B2 | 11/2011 | Valencia Sil et al. |
| 8,211,838 | B2 | 7/2012 | Valencia Sil et al. |
| 8,216,984 | B2 | 7/2012 | Valencia Sil et al. |
| 8,455,409 | B2 | 6/2013 | Valencia Sil et al. |
| 8,486,872 | B2 | 7/2013 | Morrison et al. |
| 8,759,263 | B2 | 6/2014 | Kupper et al. |
| 8,765,648 | B2 | 7/2014 | Valencia Sil et al. |
| 2004/0029741 | A1* | 2/2004 | Corby ..... B65G 45/02 508/181 |
| 2004/0053793 | A1 | 3/2004 | Li et al. |
| 2004/0214734 | A1* | 10/2004 | King ..... C10M 169/04 508/437 |
| 2004/0235680 | A1 | 11/2004 | Lawrence et al. |
| 2005/0059564 | A1 | 3/2005 | Li et al. |
| 2006/0211583 | A1 | 9/2006 | Valencia Sil et al. |
| 2008/0176778 | A1* | 7/2008 | Seemeyer ..... C10M 173/025 508/433 |
| 2008/0242567 | A1 | 10/2008 | Ornelas Vicencio et al. |
| 2008/0300156 | A1* | 12/2008 | Morales Arriaga ..... C10M 169/04 508/161 |
| 2009/0017243 | A1 | 1/2009 | Person Hei et al. |
| 2009/0111723 | A1* | 4/2009 | Shibata ..... B23H 1/08 508/463 |
| 2010/0105583 | A1* | 4/2010 | Garmier ..... C10M 169/04 508/155 |
| 2010/0292111 | A1 | 11/2010 | Villalobos Sandoval et al. |
| 2012/0241289 | A1 | 9/2012 | Valencia Sil et al. |
| 2014/0336091 | A1 | 11/2014 | Kupper et al. |
| 2014/0349899 | A1 | 11/2014 | Valencia Sil et al. |
| 2015/0119304 | A1* | 4/2015 | Jukes ..... C07C 319/14 508/332 |

FOREIGN PATENT DOCUMENTS

| | | | |
|---|---|---|---|
| JP | 2013537930 | A | 10/2013 |
| RU | 2515984 | C2 | 5/2014 |
| WO | 2003068897 | A1 | 8/2003 |

* cited by examiner

DRY LUBRICATOR FOR PLASTIC AND STAINLESS STEEL SURFACES

FIELD OF THE INVENTION

The invention relates to lubricant compositions for various surfaces, including plastic and stainless steel as found in conveying systems for passing containers. In particular, the lubricant compositions are dry compositions suitable for use in dry lubricant modes or semi-dry lubricant modes. In an aspect of the invention, the lubricant is applied on plastic and in particular on metallic conveyor belts and the like whereby the belts are efficiently lubricated. These belts are generally used in the industry, for transportation of glass, plastic, or plasticized recipients, as well as metal cans used to bottle drinks, food, or other products that may be bottled.

BACKGROUND OF THE INVENTION

At present drinks, food, or bottled products are available in different types of containers, such as glass, plastic or PET bottles, plasticized recipients, as well as metal cans, etc., whereby during processing and bottling it is necessary to transport the empty and/or full containers from one place to another, during the different stages of the industrial process to which they are submitted, using conveyor chains generally made of stainless steel or plastic, which provokes a constant friction between the conveyor chains and the containers, between the components of the conveyor chains, as well as the mutual collision among the containers during transportation.

A result of uncontrolled friction, or of an insufficient lubrication of the settings of the conveyor chains, may be a series of unfavorable situations, such as the containers tipping over or obstructing the passage (even though the conveyor chains continue operation), or otherwise, provoke more noise and discontinuity in the feeding or supply of containers to the following stages in the process, for example in the filling or labeling stages. Therefore, these situations may lead to a low performance in the stages of the process, provoking an accelerated wear of the conveyor chains and force the capacity of the motors, all the former because of an inappropriate lubrication.

Conventional solutions to the need for controlling friction in such situations includes the use of a concentrated lubricant (often soap-based or fatty amine) diluted with water to form an aqueous dilute lubricant solution (i.e., dilution ratios of 100:1 to 500:1), and copious amounts of aqueous dilute lubricant solutions are typically applied to the conveyor or containers using spray or pumping equipment. These lubricant solutions permit high-speed operation of the conveyor and limit marring of the containers or labels, but also have some disadvantages. First, dilute aqueous lubricants typically require use of large amounts of water on the conveying line, which must then be disposed of or recycled, and which causes an unduly wet environment near the conveyor line. Second, some aqueous lubricants can promote the growth of microbes. Third, by requiring dilution of the concentrated lubricant dilution errors can occur, leading to variations and errors in concentration of the aqueous dilute lubricant solution. Finally, by requiring water from the plant, variations in the water can have negative side effects on the dilute lubrication solution.

When an aqueous dilute lubricant solution is used, it is typically applied at least half of the time the conveyor is running, and usually it is applied continuously. By running the aqueous dilute lubricant solution continuously, more lubricant is used than is necessary, and the lubricant concentrate drums have to be switched out more often than necessary.

"Dry lubes" have been described as solutions to these disadvantages of dilute aqueous lubricants and have been referred to a lubricant composition with less than 50% water that was applied to a container or conveyor without dilution. However, this application typically required special dispensing equipment and nozzles and energized nozzles in particular. Energized nozzles refer to nozzles where the lubricant stream is broken into a spray of fine droplets by the use of energy, which may include high pressures, compressed air, or sonication to deliver the lubricant. Silicone materials have been the most popular "dry lube." However, silicone is primarily effective at lubricating plastics such as PET bottles, and has been observed to be less effective at lubricating on glass or metal containers, particularly on a metal surface. If a plant is running more than one type of container on a line, the conveyor lubricant will have to be switched before the new type of container can be run. Alternatively, if a plant is running different types of containers on different lines, the plant will have to stock more than one type of conveyor lubricant. Both scenarios are time consuming and inefficient for the plant.

It is against this background that the present invention has been made.

An object of the invention is to provide a dry lubricant suitable for various materials as well as suitable for maintaining lubrication in dirty zones of an application.

A further object of the invention is to provide a "universal" lubricant that may be used with a variety of container and conveyor materials.

Other objects, advantages and features of the present invention will become apparent from the following specification taken in conjunction with the accompanying drawings.

BRIEF SUMMARY OF THE INVENTION

An advantage of the invention is a total dry or semi-dry application of lubricant maintaining a coefficient of friction below about 0.2 while being suitable on various surfaces of containers along with metal (stainless steel) and plastic conveyors. It is a further advantage of the present invention that lubrication is provided in dirty zones of application, such as where spillage has occurred and before washing. It is a still further advantage of the present invention that water consumption is reduced or eliminated.

In an embodiment, the present invention provides a dry lubricant composition comprising one or more fatty acids; one or more hydrocarbons; one or more sorbitan esters; one or more polyglycols; and one or more nonionic surfactants. In an aspect, the dry lubricant compositions are substantially-free of water. In a further aspect, the dry lubricant composition provides lubricity for metal and plastic conveyors. In a still further aspect, the dry lubricant composition provides a coefficient of friction less than about 0.2.

In an embodiment, the present invention provides a dry lubricant composition comprising: from about 0.1 wt-% to about 25 wt-% of a C6-C22 fatty acids; from about 1 wt-% to about 95 wt-% of a mineral oil; from about 0.01 wt-% to about 15 wt-% of a sorbitan ester; from about 0.001 wt-% to about 10 wt-% of a polyglycol; and from about 0.1 wt-% to about 20 wt-% of a nonionic surfactant. In an aspect, the dry lubricant composition is substantially-free of water, provides lubricity for metal and plastic conveyors, and provides a coefficient of friction less than about 0.2.

In an embodiment, the present invention provides a method of lubricating a surface comprising: applying the dry lubricant compositions of the invention in a direct application to a surface in a dry mode or semi-dry mode lubrication; and forming a lubricant layer or film on the surface while maintaining a coefficient of friction less than about 0.2. In an aspect, the surface is a metal and/or plastic conveyor chain or a container in contact with the metal and/or plastic conveyor chain.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
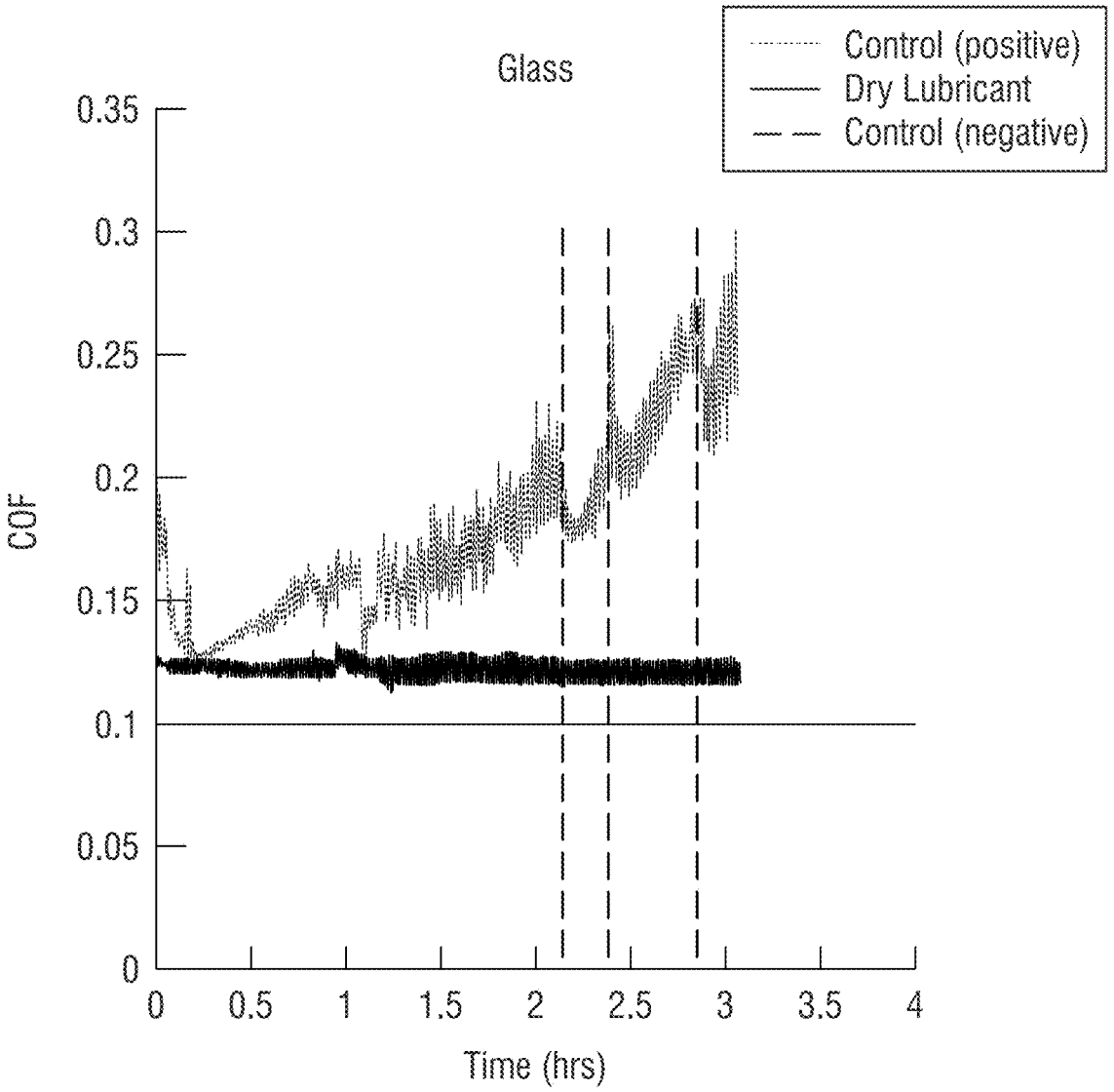
FIGS. 1A-C show lubricant efficacy of a formulation according to an embodiment of the present invention in comparison to a positive and negative control for use on a stainless steel conveyor for (1A) glass, (1B) aluminum, and (1C) PET containers.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The embodiments of this invention are not limited to particular dry or semi-dry lubricant compositions and methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

For the purpose of this patent application, successful microbial reduction is achieved when the microbial populations are reduced by at least about 50%, or by significantly more than is achieved by a wash with water. Larger reductions in microbial population provide greater levels of protection. Differentiation of antimicrobial "-cidal" or "-static" activity, the definitions which describe the degree of efficacy, and the official laboratory protocols for measuring this efficacy are considerations for understanding the relevance of antimicrobial agents and compositions. Antimicrobial compositions can affect two kinds of microbial cell damage. The first is a lethal, irreversible action resulting in complete microbial cell destruction or incapacitation. The second type of cell damage is reversible, such that if the organism is rendered free of the agent, it can again multiply. The former is termed microbiocidal and the later, microbistatic. A sanitizer and a disinfectant are, by definition, agents which provide antimicrobial or microbiocidal activity. In contrast, a preservative is generally described as an inhibitor or microbistatic composition As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%. In a preferred aspect, the dry lubricant is substantially free of water.

As used herein, the term "waters" includes food process or transport waters. Food process or transport waters include produce transport waters (e.g., as found in flumes, pipe transports, cutters, slicers, blanchers, retort systems, washers, and the like), belt sprays for food transport lines, boot and hand-wash dip-pans, third-sink rinse waters, and the like. Waters also include domestic and recreational waters such as pools, spas, recreational flumes and water slides, fountains, and the like.

The terms "water soluble" and "water dispersible" as used herein, means that the polymer is soluble or dispersible in water in the inventive compositions. In general, the polymer should be soluble or dispersible at 25° C. at a concentration of 0.0001% by weight of the water solution and/or water carrier, preferably at 0.001%, more preferably at 0.01% and most preferably at 0.1%.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, and compositions of the present invention may comprise, consist essentially of, or consist of the components and ingredients of the present invention as well as other ingredients described herein. As used herein, "consisting essentially of" means that the methods, and compositions may include additional steps, components or ingredients, but only if the additional steps, components or ingredients do not materially alter the basic and novel characteristics of the claimed methods, systems, apparatuses, and compositions.

EMBODIMENTS

Exemplary ranges of the lubricant compositions according to the invention are shown in Table 1 in weight percentage of the concentrate dry lubricant compositions.

TABLE 1

| Material | First Exemplary Range wt-% | Second Exemplary Range wt-% | Third Exemplary Range wt-% | Fourth Exemplary Range wt-% |
|---|---|---|---|---|
| Hydrocarbon (Mineral Oil) | 1-95 | 10-90 | 25-90 | 50-90 |
| Fatty Acid | 0.1-25 | 1-20 | 1-15 | 2-15 |
| Sorbitan Ester | 0.01-15 | 0.1-10 | 0.1-5 | 1-5 |
| Poly Glycol | 0.001-10 | 0.01-10 | 0.1-10 | 1-5 |
| Nonionic Surfactant | 0.1-20 | 0.5-15 | 1-10 | 1-5 |
| Additional Functional Ingredients | 0-40 | 0-25 | 0-20 | 0-10 |

The dry lubricant compositions have a pH from about 5 to 7, or preferably from about 6 to 7.

The dry lubricant compositions have a viscosity (sp3 20 rmp (cps)) from 0 to about 100, preferably from about 25 to about 100, preferably from about 25 to about 50.

The compositions form oil in water dispersions when exposed to water or another solvent as a result of the lipophilic mineral oil or component and the emulsifiers employed, making the compositions "water-miscible", that is, the compositions should they be combined with water would be sufficiently water-soluble or water-dispersible so that a stable solution, emulsion or suspension is formed. The desired use level will vary according to the particular conveyor or container application, and according to the type of mineral oil, fatty acids, and other compounds employed. This is a beneficial property as the dry lubricant compositions can be easily removed from the conveyor surface by cleaning with a water-based cleaning composition, as opposed to traditional mineral oil compositions which are not readily removed using water-based cleaning compositions. In an aspect, it is sufficiently soluble or dispersible in water so that the coating can be removed from the container or conveyor using conventional aqueous cleaners, without the need for high pressure, mechanical abrasion or the use of aggressive cleaning chemicals. However, the dry lubricant excluding water from the formulations is not so water-soluble that it runs off the conveyor when it encounters water or spilled beverage normally present during the bottling process.

The dry lubricant compositions are provided as concentrate compositions or may be diluted to form ready to use compositions for semi-dry applications of use. In general, a concentrate refers to a composition that is not (or not yet diluted) with water or other solvent to provide a use solution that contacts an object to provide the desired lubrication, cleaning, or the like. The dry lubricant composition that contacts the articles or surfaces to be lubricated can be referred to as a concentrate or a use composition (or use solution) dependent upon the formulation employed in methods according to the invention. It should be understood that the concentration of the active components in the dry lubricant composition will vary depending on whether the composition is provided as a concentrate or as a diluted composition, such as for a semi-dry application of use.

In a preferred aspect, the dry lubricant is applied for use in an undiluted formulation. In a further aspect, the dry lubricant composition is substantially-free of water. Preferably, the dry lubricant composition is has less than 1 wt-% of water, or less than 0.5 wt-% of water. In another embodiment, the amount of water is less than 0.1 wt-% and in yet another embodiment, the amount of water is less than 0.01 wt-%. The amount of water referred to herein includes any added water to the dry lubricant formulation, and preferably any water of addition from the components of the formulation as well.

A desirable dilution of the dry lubricant according to the invention to provide a semi-dry application provides an oil in water dispersion, the concentration of which may vary from about 0.01% to about 5%, preferably from about 0.1% to about 1%, or more preferably from about 0.1% to about 0.5%, and more preferably about 0.2%. In an aspect of the invention, water is employed as a solvent to form a ready-to-use formulation for use in a semi-dry application and one skilled in the art will ascertain that performance considerations of a particular application of use for the lubricator will impact the concentration. Exemplary dilution ranges for diluted applications of the dry lubricant are from about 100:1 to 500:1, beneficially allowing an extremely high dilution (which is distinct from conventional lubricants, such as disclosed in U.S. Pat. No. 6,207,622). For such applications of use employing a diluted lubricant composition (or a ready-to-use formulation) a flow meter is preferably installed to quantify or dose water of dilution.

Beneficially, the dry lubricant compositions exhibit a decrease in COF after the composition is applied to the conveyor (or containers) and remains dries on the conveyor (or containers). In an embodiment, the present compositions maintain effective lubrication after the composition is applied to the conveyor and remains dry on the conveyor. The invention provides a lubricant coating that reduces the coefficient of friction of coated conveyor parts and containers and thereby facilitates movement of containers along a conveyor line. In an embodiment the lubricant maintains a coefficient of friction below about 0.4, below about 0.2, below about 0.15, below about 0.12, and preferably below about 0.1.

As a further benefit, the dry lubricant compositions are compatible with non-refillable PET bottles and/or barrier bottles, such as those used with carbonated soft drinks as determined using a PET Stress Crack Test. In a further embodiment, the dry lubricant compositions are compatible with refillable PET bottles useful for carbonated soft drinks as determined using a PET Stress Crack Test for refillable bottles. For example, the dry lubricant compositions result in a grade in such a test of A or B. In an example, the present composition can result in a grade in such a test of A.

Hydrocarbon—Mineral Oil

The lubricant compositions include a dissolvent that can be one or more mineral oils or hydrocarbons. In an alternative, the dissolvent can be a mineral oil or hydrocarbon as well an aliphatic such as benzene, or a mixture of these. Saturated aliphatic hydrocarbon can be linear or ramified, there may be, for example, alkanes of the general formula $C_nH_{2n+2}$ such as heptane, octane, nonane, decanes, pentadecanes, alkenes of the general formula $C_nH_{2n}$ such as ethane, propene, butane, pentene, and alkynes of the general formula $C_nH_{2n-2}$ such as ethyne, propine, butane, pentene.

In an aspect, preferred aliphatic hydrocarbons include mineral oils of high purity, such as for example white mineral oils. In an aspect, preferred benzene hydrocarbons include for example, those of the general formula $C_nH_{2n-6}$ such as benzene, toluene, xylenes, and isomers.

In an aspect, the compositions include from about 1 wt-%-95 wt-% mineral oil, from about 10 wt-%-90 wt-% mineral oil, from about 25 wt-%-90 wt-% mineral oil, preferably from about 50 wt-%-90 wt-% mineral oil, and more preferably from about 70 wt-%-85 wt-% mineral oil. In addition, without being limited according to the invention, all ranges recited are inclusive of the numbers defining the range and include each integer within the defined range.

Beneficially, the mineral oil or hydrocarbon base ingredient or dissolvent of the dry lubricant compositions replaces the need for water and/or polylakylglycol base components for the lubricant compositions as are used in many lubricant compositions. See for example U.S. Pat. No. 6,207,622 employing a hydrophilic material (silicon emulsion and glycerol) material up to 85 wt-% of the lubricant, U.S. Publication No. 2008/0242567 employing a polylalkylglycol material up to 50 wt-% of the lubricant, and U.S. Publication No. 2010/0292111 employing a polylalkyleneglycol material up to 50 wt-% of the lubricant. Beneficially, the replacement of the hydrophilic materials with the mineral oil or hydrocarbon base ingredient provides improved lubrication, including in areas with rinsing and product spillage.

Fatty Acid

The lubricant compositions include a fatty acid component. The fatty acid is one or more fatty acids to increase the lubricity of the lubricant and beneficially enables the compositions to be used in containers of varied materials such as metal, glass, plasticized bottles, etc. The fatty acid consists of an alkyd chain with a terminal carboxylic group, being the simplest configuration the completely saturated lineal chain. Fatty acids are classified in fatty acids of short, medium, and long chains, and through their saturation grade in saturated and unsaturated, the latter divided in turn in mono-unsaturated fatty acids and poly-unsaturated acids.

In an aspect, the fatty acids have a lineal chain of 8 to 22 carbon atoms, whether saturated, unsaturated, or substituted. Exemplary saturated fatty acids include for example, the caprylic acid of 8 carbon atoms, the capric acid of 10 carbon atoms, the undecylic acid of 11 carbon atoms, the lauric acid of 12 carbon atoms, the tridecyl acid of 13 carbon atoms, the myristic acid of 14 carbon atoms, the palmitic acid of 16 carbon atoms, the stearic acid of 18 carbon atoms; among the mono-unsaturated fatty acids there may, for example, the lauroleic acid of 12 carbon atoms, the myristoleic acid of 14 carbon atoms, the palmitoleic acid of 16 carbon atoms, and preferably the oleic acid of 18 carbon atoms; among the poly-unsaturated fatty acids there may be, for example, the linoleic acid (de-unsaturated) of 18 carbon atoms and the linolenic acid (tri-unsaturated) of 18 carbon atoms, and among the substituted fatty acids there may be, for example, the ricinoleic acid of 18 carbon atoms substituted by hydroxide.

In an aspect, mixed fatty acids, such as the derivatives from greases and oils may be used in the lubricant composition of this invention, as for example, the fatty acid from coconut oil, or the fatty acid from liquid resin.

In an aspect, the compositions include from about 0.1 wt-%-25 wt-% fatty acid, from about 1 wt-%-20 wt-% fatty acid, from about 1 wt-%-15 wt-% fatty acid, preferably from about 2 wt-%-15 wt-% fatty acid, and more preferably from about 5 wt-%-10 wt-% fatty acid. In addition, without being limited according to the invention, all ranges recited are inclusive of the numbers defining the range and include each integer within the defined range.

Sorbitan Ester

The lubricant compositions include a non-ionic emulsifier with lipophylic characteristics. Beneficially, the emulsions of water in oil with a balanced lipophylic and hydrophilic performance are formulated through use of the non-ionic emulsifier, namely a sorbitan ester. The emulsifier type performs in this case an important role in stabilizing the emulsion and is a preferred election in the group comprising the systems constituted by sorbitan esters and ethoxylated sorbitan esters.

In an aspect, sorbitan esters include for example, sorbitan monooleate, sorbitan monolaurate, sorbitan monoestearate, sorbitan triestearate, polyoxyethylenated sorbitan trioleate with 14 to 40 ethylene oxide mols, ethoxylated sorbitan monoolaurate of 11 to 40 mols of ethylene oxide, polyethyleneglycol monooleate with a molecular weight comprised between 480 and 1200, and the ethoxylated nonilphenol of 6 to 50 mols of ethylene oxide.

Exemplary sorbitan esters include for example, the TWEEN™ series 20, 40, 60, 80 and 85 polyoxyethylene sorbitan monooleates and SPAN™ series 20, 80, 83 and 85 of sorbitan esters.

In an aspect, the compositions include from about 0.01 wt-%-15 wt-% sorbitan esters, from about 0.1 wt-%-10 wt-% sorbitan esters, from about 1 wt-%-10 wt-% sorbitan esters, from about 0.1 wt-%-5 wt-% sorbitan esters, preferably from about 1 wt-%-5 wt-% sorbitan esters. In addition, without being limited according to the invention, all ranges recited are inclusive of the numbers defining the range and include each integer within the defined range.

Hydroxy-Containing Lubricants

The lubricant compositions includes a water-miscible lubricant that is a hydroxy-containing compounds such as polyols (e.g., glycerol and propylene glycol); polyalkylene glycols (e.g., polyethylene and methoxypolyethylene glycols); and/or linear copolymers of ethylene and propylene oxides. Preferably, the hydroxy-containing compounds are a polymer or copolymers of poylglycols. In an aspect, the copolymers are a block of polyglycol, particularly polyalkylene-glycol or any other polyalkylene-glycol oxide of a high molecular weight, soluble in water. The polyalkylene-glycol has the following general structure:

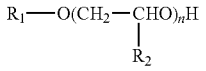

Wherein $R_1$ is a hydrogen or alkyl of $C_1$ to $C_4$; $R_2$ is a hydrogen, methyl, or their mixtures; and n is a whole number.

In an aspect when $R_2$ is hydrogen, these materials are polymers of ethylene oxide that are also known as polyethyleneglycols. When $R_2$ is methyl, these materials are polymers of propylene oxide that are also known as polypropylene glycols. When $R_2$ is methyl, there are also various isomers included, of the resulting polymer position that may exist. The polyalkylene-glycols, polyethyleneglycols, polypropylene glycols, and combinations thereof are preferred for their use in the lubricant of this invention. In an aspect, polyethyleneglycols are particularly preferred polyl glycols for the lubricant compositions.

In an aspect, the compositions include from about 0.001 wt-%-10 wt-% polyl glycols, from about 0.01 wt-%-10 wt-% polyl glycols, from about 0.1 wt-%-10 wt-% polyl glycols, from about 0.1 wt-%-5 wt-% polyl glycols, preferably from about 1 wt-%-5 wt-% polyl glycols. In addition, without being limited according to the invention, all ranges recited are inclusive of the numbers defining the range and include each integer within the defined range.

Nonionic Surfactants

In some embodiments, the compositions of the present invention include a nonionic surfactant suitable for aiding in emulsification of the lubricant compositions. In an aspect, the compositions include from about 0.1 wt-%-20 wt-% nonionic surfactant, from about 0.5 wt-%-15 wt-% nonionic surfactant, from about 1 wt-%-10 wt-% nonionic surfactant, and preferably from about 1 wt-%-5 wt-% nonionic surfactant. In addition, without being limited according to the invention, all ranges recited are inclusive of the numbers defining the range and include each integer within the defined range.

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Lutensol™, Dehydol™ manufactured by BASF, Neodol™ manufactured by Shell Chemical Co. and Alfonic™ manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

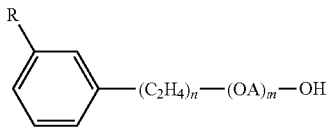

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated)

thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

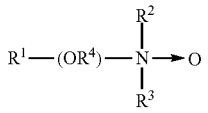

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

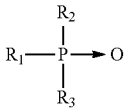

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis (hydroxymethyl)tetradecylphosphine oxide.

Semi-polar nonionic surfactants useful herein also include the water soluble sulfoxide compounds which have the structure:

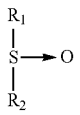

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 ($R\text{-}(EO)_5(PO)_4$) and Dehypon LS-36 ($R\text{-}(EO)_3(PO)_6$); and capped alcohol alkoxylates, such as Plurafac LF221 and Tegoten EC11; mixtures thereof, or the like.

Additional Functional Ingredients

The components of the lubricant composition can further be combined with various functional components. In some embodiments, the lubricant composition including the mineral oil, fatty acid, sorbitan esters, poly glycols, and nonionic surfactant make up a large amount, or even substantially all of the total weight of the lubricant composition. For example, in some embodiments few or no additional functional ingredients are disposed therein.

In other embodiments, additional functional ingredients may be included in the lubricant compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use.

In preferred embodiments, the compositions do not include silicone fluids, emulsions or components which undesirably present formulation limitations for use on metal surfaces, in addition to plastic surfaces. Exemplary silicone materials, which are excluded from the dry lubricant compositions, includes for example silicone emulsions (such as emulsions formed from methyl(dimethyl), higher alkyl and aryl silicones; and functionalized silicones such as chlorosilanes; amino-, methoxy-, epoxy- and vinyl-substituted siloxanes; silanols); polydimethylsiloxanes, high molecular weight hydroxy-terminated dimethyl silicone; anionic and/or cationic surfactants employing silicon functional groups; silicone powders; and the like.

In other embodiments, the compositions may include antimicrobial agents, colorants, defoaming agents or foam generators, cracking inhibitors (e.g. PET stress cracking inhibitors), film-forming materials, additional surfactants, anti-redeposition agents, bleaching agents, solubility modifiers, dispersants, rinse aids, metal protecting agents, stabilizing agents, corrosion inhibitors, tracers, additional sequestrants and/or fragrances and/or dyes, rheology modifiers or thickeners, hydrotropes or couplers, buffers, solvents and the like. The amounts and types of such additional components will be apparent to those skilled in the art.

Useful emulsifier agents include ethoxylate compounds providing further lubricant benefits, based on one or more of the group including alcohol ethoxylates, chlorine, methyl, propyl or butyl end capped alcohol ethoxylates, ethoxylated alkyphenol compounds, and poly(ethylene oxide-propylene oxide) copolymers, such as those disclosed in U.S. Pat. No. 5,559,087 which is incorporated herein by reference in its entirety. A particularly preferred ethoxylate compound for use as an additional emulsifier in the dry lubricant composition is an ethoxylated lauryl alcohol.

Useful antimicrobial agents include disinfectants, antiseptics and preservatives. Non-limiting examples of useful antimicrobial agents include acidic polysaccharides, phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, aldehydes such as glutaraldehyde, antimicrobial dyes such as is acridines, triphenylmethane dyes and quinones and halogens including iodine and chlorine compounds. The antimicrobial agents can be used in an amount sufficient to provide desired antimicrobial properties. For example, from 0 to about 20 weight percent, preferably about 0.05 to about 10 weight percent of antimicrobial agent, or preferably about 0.1 to about 5 weight percent of antimicrobial agent based on the total weight of the dry lubricant composition.

Useful foam inhibitors include methyl silicone polymers. Non-limiting examples of useful foam generators include surfactants such as non-ionic, anionic, cationic and amphoteric compounds. In a preferred embodiment non-silicone polymers are employed as foam inhibitors and/or foam generators. These components can be used in amounts to give the desired results.

Useful viscosity modifiers include pour-point depressants and viscosity improvers such as polymethacrylates, polyisobutylenes and polyalkyl styrenes. The viscosity modifier is used in amount to give desired results, for example, from 0 to about 30 weight percent, preferably about 0.5 to about 15 weight percent, based on the total weight of the composition.

Useful esters for use in the dry lubricant compositions to prevent or reduce residues experienced overtime from use of the dry lubricant compositions employing a mineral oil, include for example fatty esters. In an aspect, a fatty ester may be used in combination with the concentration of mineral oil in the formulations or may replace all or a portion of the mineral oil. Particularly useful esters include, for example, emollient esters, polyesters and the like. Esters include a —OCO-moiety. In some embodiments, the ester preferably includes no atoms other than carbon, hydrogen and oxygen atoms. In some embodiments, the ester preferably includes carboxy (—COO—) oxygen atoms; and may include ether (—O—) oxygen atoms. An example of a commercially available ester suitable for use with the dry lubricant compositions to prevent residues are Crodamol® products from Croda (ester based).

Useful tracers or tracing components for use in the dry lubricant compositions include for example fluorescent compounds. Such compounds are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). Such components are commercially available and will be appreciated by those skilled in the art. Exemplary tracers or tracing components which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene, examples of which are available under the trade name Tinopal CBS-X. Other commercially available tracers or tracing components are available under the names are stilbene3; FBA351, and benzenesulfonic acid 2,2"-(4,4"-biphenylylenedivinylene)di-disodium salt. Other fluorescent tracers used in the lubricant of the invention are thiophene of benzoxazole, benzoxazole thiophene, aminotriazine formaldehyde co-condensates with organic dyes, and combinations thereof, and where the organic dyes of aminotriazine formaldehyde co-condensates may be pigmented melanin, sulfonamide, copolymer of formaldehyde. Additional description of suitable fluorescent tracers is set forth in U.S. Publication No. 2010/0292111, which is herein incorporated by reference in its entirety.

Methods of Use

In an embodiment, the present invention relates to a method for lubricating the passage of a container along a conveyor. This embodiment can include applying a lubricant composition to at least a portion of a container-contacting surface of the conveyor or to at least a portion of a conveyor-contacting surface of the container. In an aspect, the lubricant compositions are applied directly on the surface of the plastic and/or metallic chains, such as those found on a conveyor belt surface, without any extra dissolvent. In an aspect, the application can be performed through the preferred use of a manual or automatic sprayer or nozzle that spray the conveyor chain surface with the lubricant composition. Alternatively, the lubricant compositions can be applied with a brush, such as a plastic brush with nylon bristles (with a thickness of approximately 0.38 mm) that allows an adequate distribution of the lubricant along the conveyor chain to form a permanent layer or film of lubricant on the surface of said conveyor chain.

The lubricant coating can be applied in a constant or intermittent fashion. The lubricant may be applied in a discontinuous fashion and in prolonged intervals between the applications. Preferably, the lubricant coating is applied in an intermittent fashion in order to minimize the amount of applied lubricant composition. It has been discovered that the present invention may be applied intermittently and maintain a low coefficient of friction in between applications, or avoid a condition known as "drying". Specifically, the present invention may be applied for a period of time and then not applied for at least 10 minutes or longer, or at least 15 minutes or longer for a semi-dry mode. The present invention may be applied for a period of time and then not applied for at least an hour, or at least 2 hours, or at least 4 hours or longer for a total-dry mode. The application period may be long enough to spread the composition over the conveyor belt (i.e. one revolution of the conveyor belt). During the application period, the actual application may be continuous, i.e. lubricant is applied to the entire conveyor, or intermittent, i.e. lubricant is applied in bands and the containers spread the lubricant around. The lubricant is preferably applied to the conveyor surface at a location that is not populated by packages or containers. For example, it is preferable to apply the lubricant spray upstream of the package or container flow or on the inverted conveyor surface moving underneath and upstream of the container or package.

In some embodiments, the ratio of application time to non-application time may be at least 1:10, at least 1:20, at least 1:30, at least 1:180, and at least 1:500, and wherein the lubricant maintains a low coefficient of friction in between lubricant applications.

In some embodiments, the lubricant maintains a coefficient of friction below about 0.4, below about 0.2, and preferably below about 0.15 or below about 0.12.

In some embodiments, a feedback loop may be used to determine when the coefficient of friction reaches an unacceptably high level. The feedback loop may trigger the lubricant composition to turn on for a period of time and then optionally turn the lubricant composition off when the coefficient of friction returns to an acceptable level.

A layer of the lubricant composition is applied to treated surfaces. In an embodiment, the lubricant coating thickness provides a coefficient of friction below about 0.4, below about 0.2, and preferably below about 0.15 or below about 0.12. In other embodiments, the lubricant coating thickness provides a coefficient of friction below about 0.4, below about 0.2, and preferably below about 0.15 or below about 0.12 and preferably is maintained generally at the interface at least about 0.0001 mm, more preferably about 0.001 to about 2 mm, and most preferably about 0.005 to about 0.5 mm.

In some embodiments, the lubrication is provided by the dry lubricant in dirty zones of application of use, such as where spillage has occurred and before washing. Beneficially, the dry lubricant composition whether used in clean or dirty zones does not cause reduction in the coefficient of friction, such that the lubrication is maintained. In an aspect, the dry lubricant provides a coefficient of friction below about 0.4, below about 0.2, below about 0.15, below about 0.12, and preferably below about 0.1 in both clean and dirty zones.

Application of the lubricant composition can be carried out using any suitable technique including spraying, including standard energized (e.g. pressurized) or non-energized spray nozzle systems, wiping, brushing, drip coating, roll coating, hydraulic systems, and other methods for application of a thin film. In a preferred aspect, the application of the lubricant composition is with a spray nozzle.

In an aspect of the invention, the lubricant composition is applied directly without diluting on the conveyor chain to form a lubricant layer that adheres to the surface of the conveyor chain for a period that may last up to 8 hours. In a preferred aspect, the lubricant composition is applied directly without diluting on a plastic conveyor chain to form a lubricant layer that adheres to the surface of the conveyor chain for a period that may last up to 8 hours.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). In an embodiment of the method, the container preferably includes polyethylene terephthalate, polyethylene naphthalate, glass, or metal. The containers can have a variety of sizes and forms, including cartons (e.g., waxed cartons or TETRAPACK™ boxes), cans, bottles and the like.

Although any desired portion of the container can be coated with the lubricant composition, the lubricant composition preferably is applied only to parts of the container that will come into contact with the conveyor or with other containers.

Preferably, the lubricant composition is not applied to portions of thermoplastic containers that are prone to stress cracking. However, beneficially according to the invention, the dry lubricant compositions are PET compatible and do not cause stress cracking.

In a preferred embodiment, the present invention relates to a method for lubricating the passage of a container along a conveyor. This embodiment can include applying an undiluted lubricant composition to at least a portion of a container-contacting surface of the conveyor or to at least a portion of a conveyor-contacting surface of the container; conveying containers on the conveyor; washing or rinsing the conveyor and removing soil; continuing to convey containers after washing, conveying being conducted with a coefficient of friction of less than or equal to about 0.2. In an embodiment of the composition, the composition is PET compatible to the extent that is graded A or B in a stress cracking test for refillable PET bottles.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

A Lubricity Test was conducted to measure frictional force of a cylinder vessel on a short track lubricated by control formulations and a dry lubricant formulation according to the invention. The bottom of a cylinder packages made of mild steel (aluminum), glass, or PET were loaded with approximately 20 liters of water, and the short track conveyor belt was either stainless steel or delrin (plastic). The short track conveyor belt was washed with water and rinsed for at least 20 minutes.

The lubricant formulations were prepared and dosed using nozzles for dosing equipment. The short track conveyor belt was run for 30 minutes before taking an initial measurement. The dynamometer was zeroed out and the cylinder bottlers were placed on the conveyor and fastened with a cord to the dynamometer to register force readings. The drag force, using an average value, was measured with a solid state transducer, which was connected to the cylinder by a thin monofilament fishing line. The drag force was monitored with a strip chart recorder. The coefficient of friction (COF), also referred to as the lubrication value, was calculated by dividing the drag force (F) by the weight of the cylinder package (W): COF=F/W. Measurements were obtained every 10-30 minutes until the full consumption of the lubricant formulations (or control formulations). Additional observations were obtained, including for example, foam formation, sounds of conveyor, appearance and cleaning of the conveyor.

The conveyor and the cylinder bottles were cleaned for the application of lubricant formations. The test duration was 4 hours using 23.72 g aluminum cans, 28.37 g glass bottles and PET bottles on the stainless steel conveyor track. The test duration was also 4 hours using 26.45 g aluminum cans, 23.90 g glass bottles and PET bottles on the plastic conveyor tract.

A control using a commercially available silicon and fatty amine-based lubricant (Control (positive) DryExx®, Ecolab Inc., St. Paul, Minn.), a control using water spray along on the track (Control (negative)), and a formulation according to the formula in Table 2 (Dry Lubricant) were evaluated for use as "dry" lubricants for various containers on a stainless steel and a delrin (plastic) conveyor. Lubricant compositions were applied to the surface of the belt using a 4 inch brush applicator without any dilution; which is representative of application by various means including commercial uses often employing nozzle application to spray the dry lubricant compositions on a surface in need of treatment. The amount of initial lubricant applied was 28 grams for the stainless steel conveyor and 26 grams for the delrin (plastic) conveyor. After the initial application of lubricant, the belt was allowed to run for 4 hours without application of additional lubricant while the force exerted on the strain gauge was recorded.

TABLE 2

| Formulation | Wt-% |
|---|---|
| Mineral Oil | 83.8 |
| C18 Fatty Acid | 10 |
| Sorbitan monooleate | 3 |
| Polyethylene glycol | 1 |
| Ethoxylated lauryl alcohol | 2 |
| Disinfectant | 0.2 |

Figure 1B:
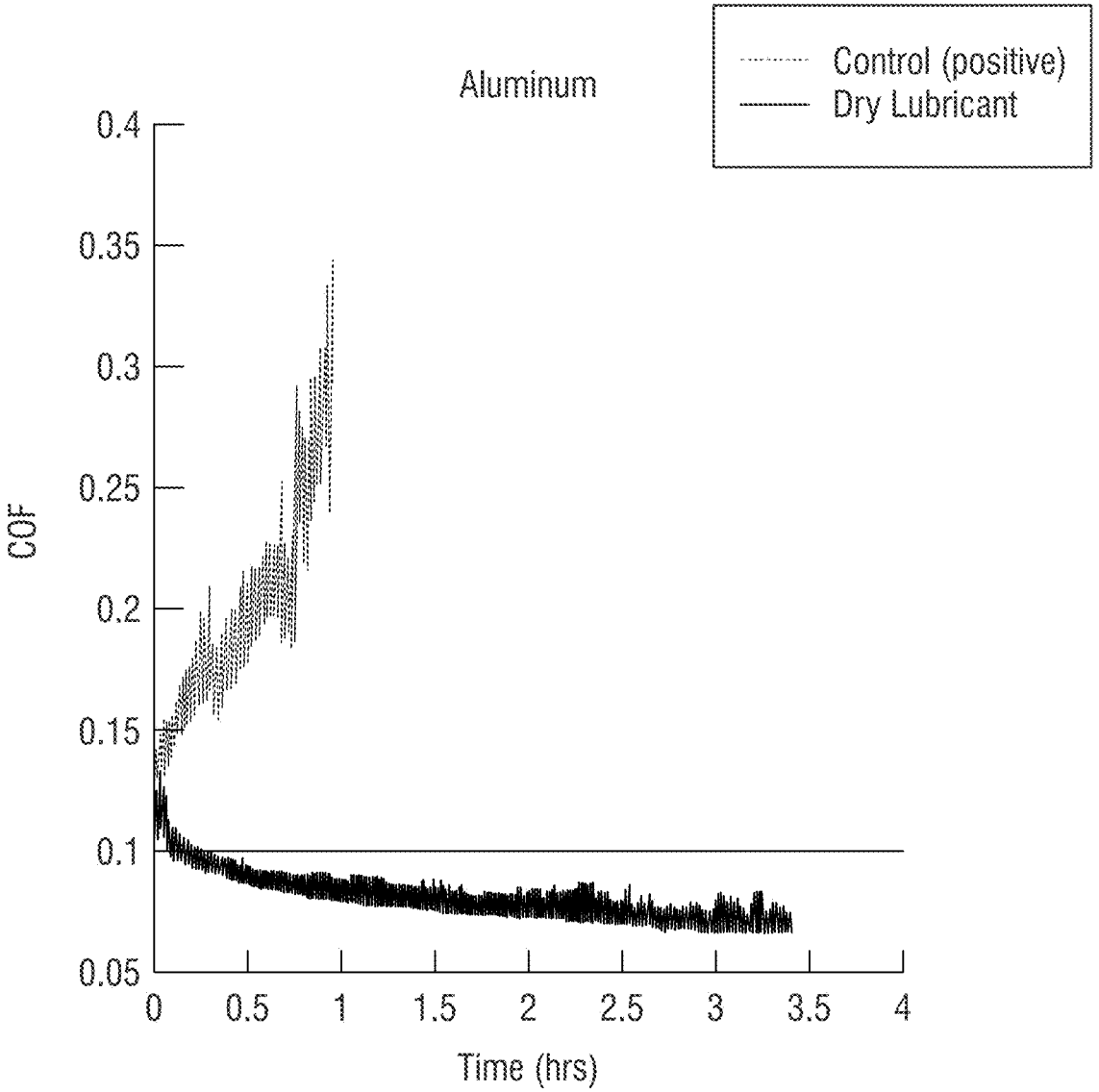
Figure 1C:
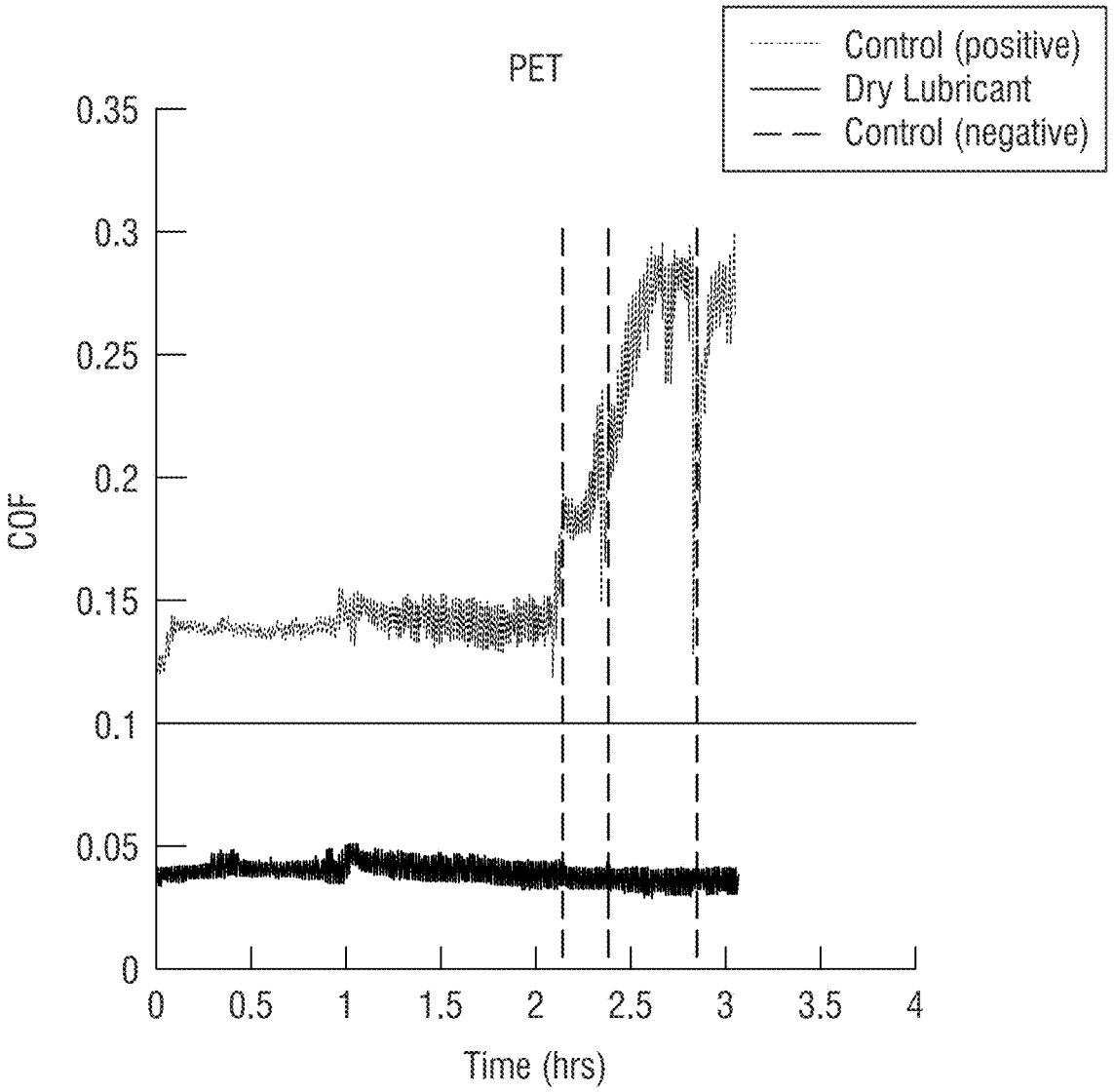
Figure 2A:
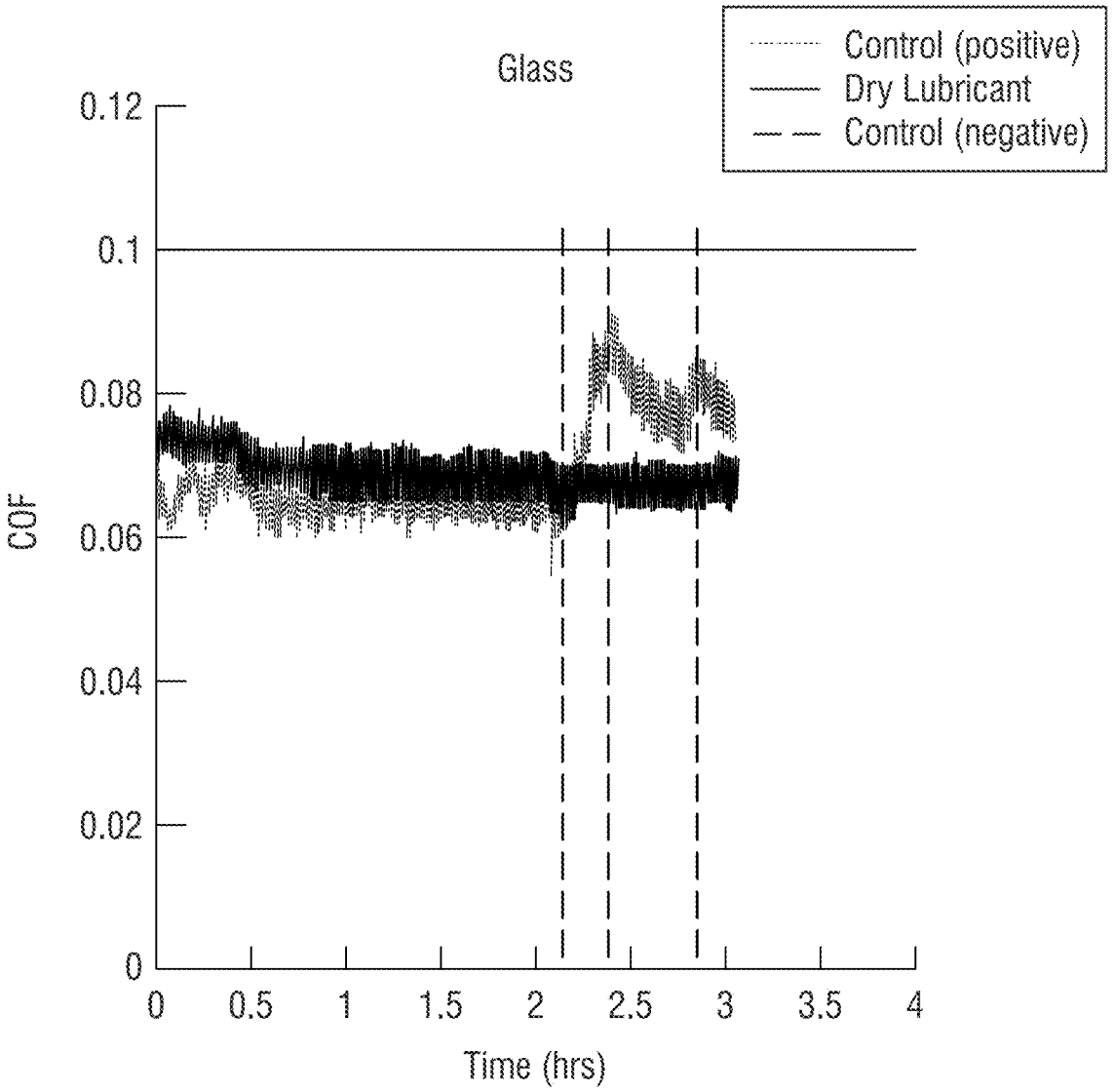
FIGS. 2A-C show lubricant efficacy of a formulation according to an embodiment of the present invention in comparison to a positive and negative control for use on a delrin (plastic) conveyor for (2A) glass, (2B) aluminum, and (2C) PET containers.
Figure 2B:
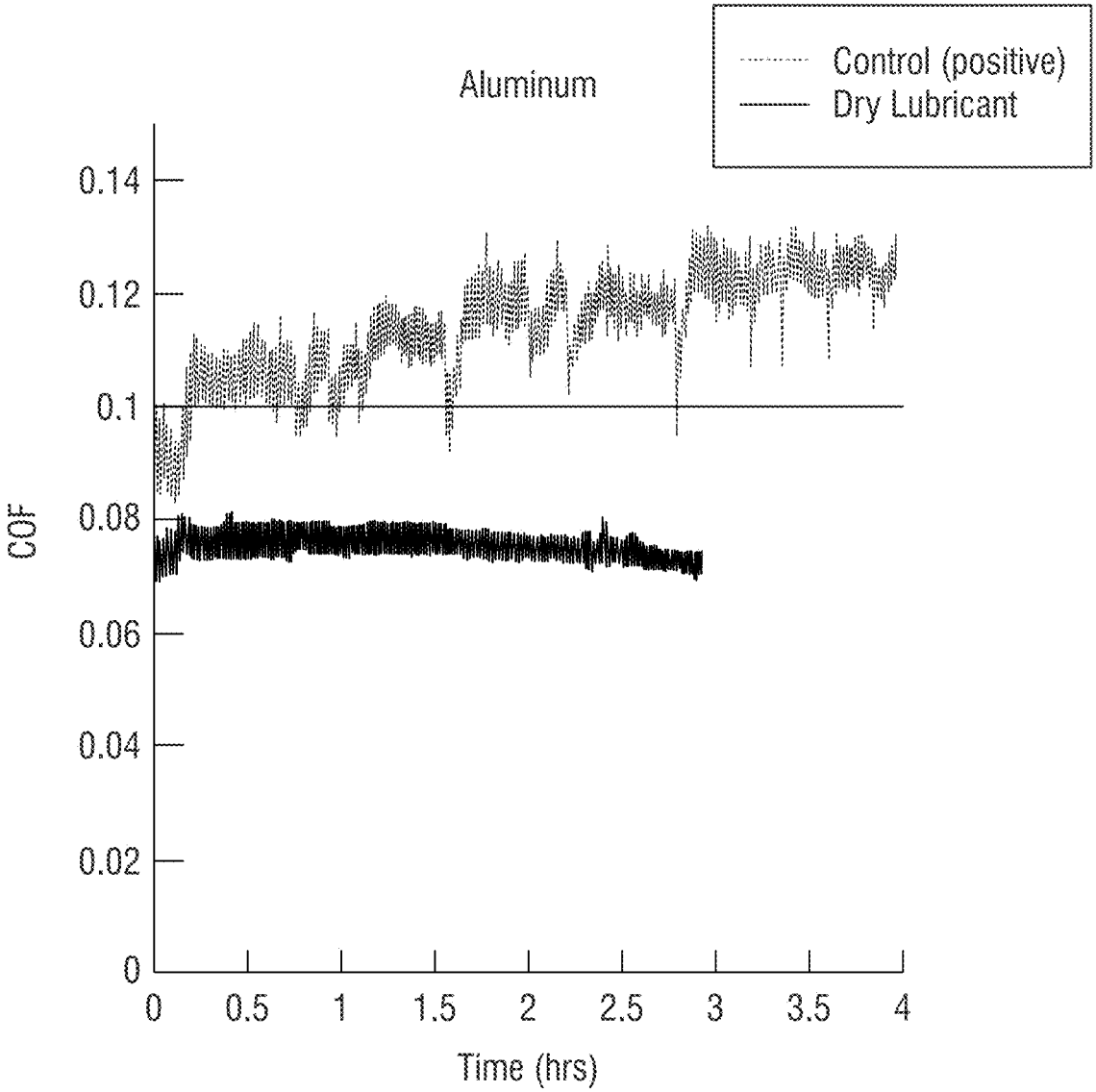
Figure 2C:
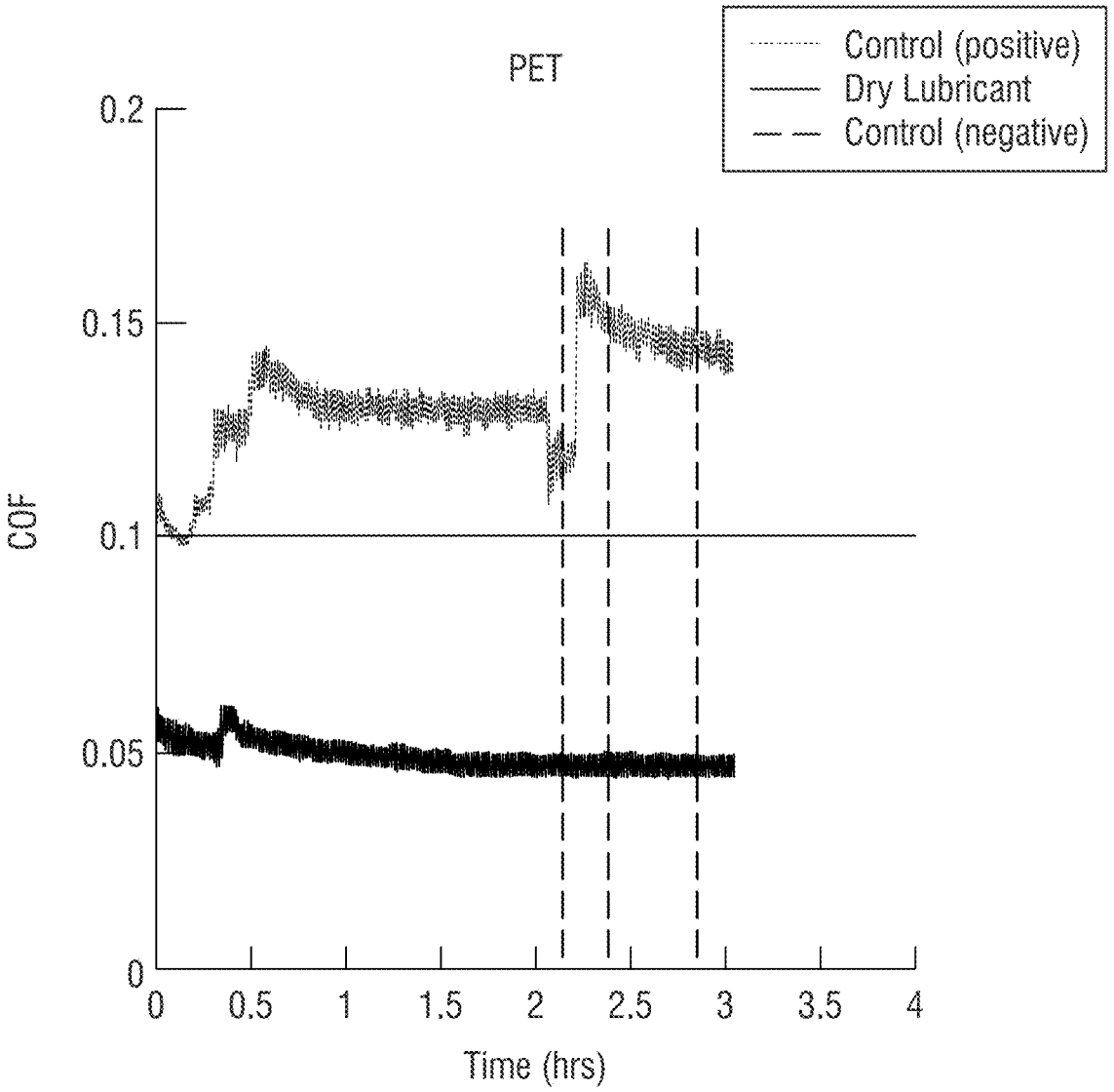

The results are shown in FIGS. 1A-C (stainless steel conveyor for (A) glass, (B) aluminum, and (C) PET containers) and 2A-C (delrin (plastic) conveyor for (A) glass, (B) aluminum, and (C) PET containers). These experiments demonstrated that conventional lubricant compositions showed unacceptable increases in coefficient of friction and are not suitable for dry mode application.

The dry lubricant according to an embodiment of the invention was more effective (lower coefficient of friction (COF)) on all surfaces in dry mode than the positive and negative controls. Beneficially, the Dry Lubricant according to the invention produced a COF below at least 0.2 on all surfaces, and below 0.1 on all surfaces except glass with the metal conveyor (wherein the COF slightly exceeded 0.1), demonstrating coefficients of friction that are desirable in the industry and outperform positive controls for use as dry lubricants.

Example 2

An exemplary dry lubrication formulation according to the invention was evaluated for PET compatibility utilizing a PET stress crack evaluation. Compatibility of lubricant compositions with PET beverage bottles was determined by charging bottles with carbonated water, contacting with the lubricant composition, storing at elevated temperatures and humidity for a period of 28 days, and counting the number of bottles that either burst or leaked through cracks in the base portion of the bottle. Standard Coca-Cola 2 liter bottles were filled with tap water and stored under ambient conditions (20-25° C.) overnight. Twenty four bottles were pressurized and then dry lubricant composition was applied (including at 10 times concentrate) and remained in contact for 7 days under the maintained pressure of 45 psi, then placed in a standard bus pan lined with a polyethylene bag. For each composition tested, a total of four bus pans of 24 bottles were used. Immediately after placing bottles and test aqueous composition into bus pans, the bus pans were moved to an environmental chamber under conditions of 100° F. and 85% relative humidity. Bins were checked on a daily basis and again after 14 days of compete testing and the number of failed bottles (burst or leak of liquid through cracks in the bottle base) was recorded.

The dry lubricant formulations evaluated included soft water (Control (negative)), the Dry Lubricant Concentrate (formulation in Example 1, Table 2), and the Dry Lubricant 0.2%.

The evaluation of the degree of crazing was done according the Coca Cola-Line Lubrication Stress Crack Test. Four categories are established A, B, C, and D (including a (−) or (+) grading available for each), with evaluation grades as follow:

A: Minor, very shallow cracking;
B: Moderate, shallow cracking;
C: Major, moderately deep cracking;
D: Major deep cracking.

Figure 3A:
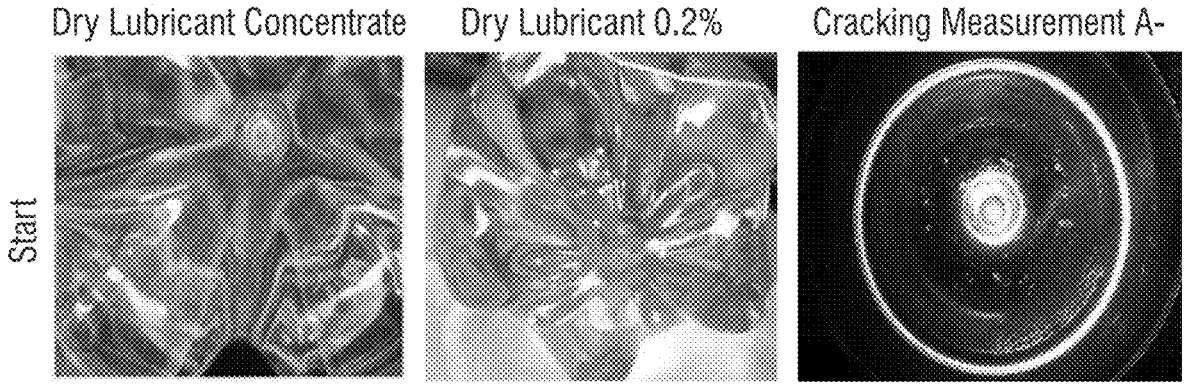
FIGS. 3A-C show photographs of PET stress cracking assessment using dry lubricant formulations according to embodiments of the invention, including concentrate and 0.2% dry lubricant, at (3A) starting measurements, (3B) 7 days with lubricant, and (3C) after 14 days with lubricant.
Figure 3B:
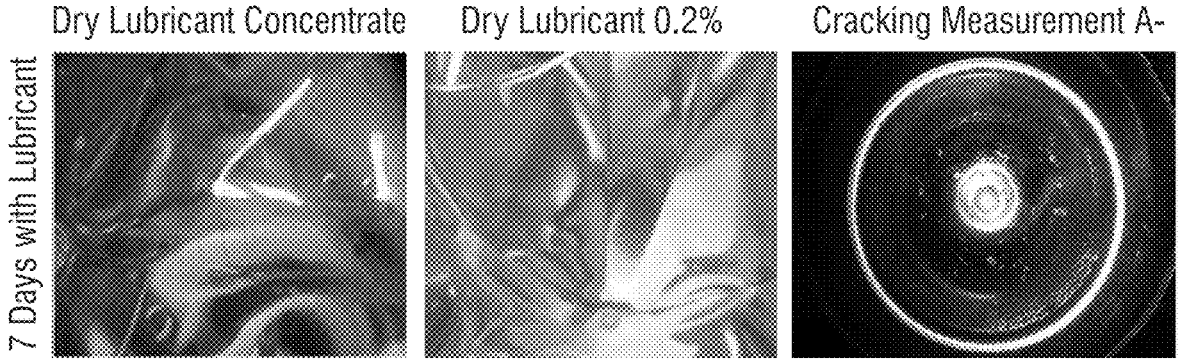
Figure 3C:
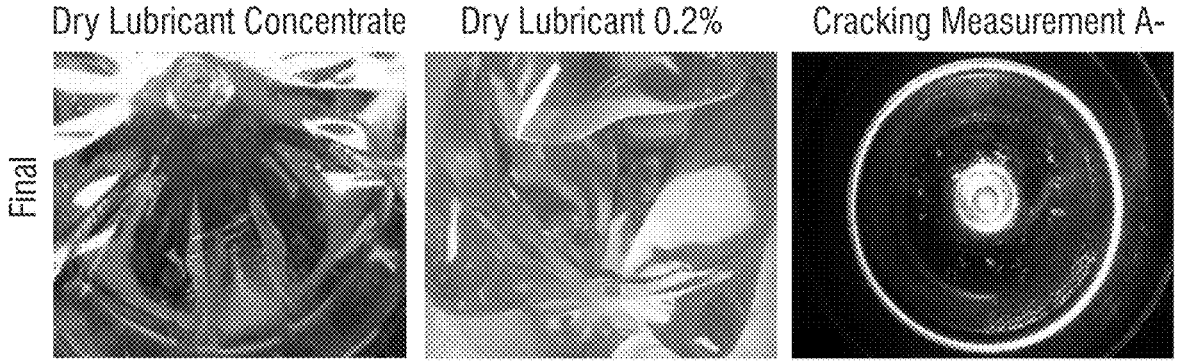

The results are shown in FIGS. 3A-C which demonstrate that a conveyor lubricant composition according to the present invention exhibited an advantageous low level of stress cracking in a standard test for compatibility with PET bottles. FIG. 3A show the starting measurements, FIG. 3B show the measurements at 7 days with lubricant, and FIG. 3C show the final measurements after 14 days with lubricant.

Table 3 provides further summary of the evaluation.

TABLE 3

| | Soft Water (Negative Control) | Dry Lubricant 0.2% solution | Dry Lubricant Concentrate | Observations |
|---|---|---|---|---|
| 7 days in direct contact | Without stress cracking formation | Light formation of stress cracking in the bottom of bottle | Formation of stress cracking in the bottom of bottle | No bottle breakage |
| 7 days subsequent storing at room temperature | Without stress cracking formation | No change in stress cracking formation | No change in stress cracking formation | No bottle breakage |
| Final Results | No cracking formation | A− | A− | No bottle breakage |

The results show that overall the dry lubricant according to the invention provided excellent PET compatibility with PET beverage bottles.

Example 3

The methods of Example 2 where further used to evaluate an exemplary dry lubrication formulation according to the invention for use with returnable PET bottles utilizing a PET stress crack evaluation. The dry lubricant formulations evaluated included soft water (Control (negative)), the Dry Lubricant Concentrate (formulation in Example 1, Table 2), and the Dry Lubricant 0.2%.

Figure 4A:
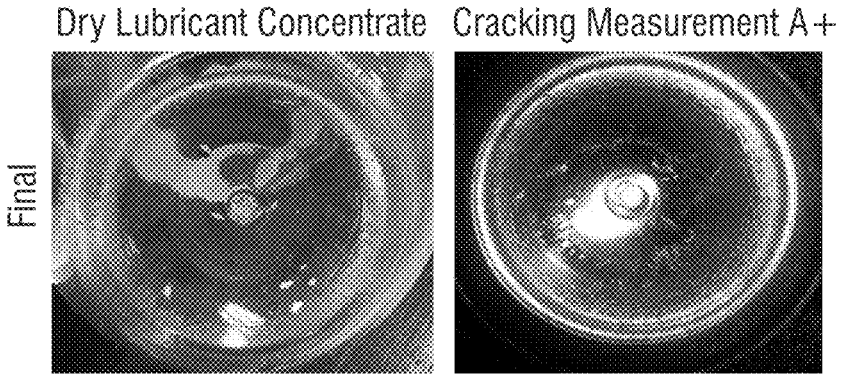
FIGS. 4A-B show photographs of PET stress cracking assessment using dry lubricant formulations according to embodiments of the invention on returnable PED containers, including concentrate (4A) and 0.2% dry lubricant (4B) after 14 days with lubricant.
Figure 4B:
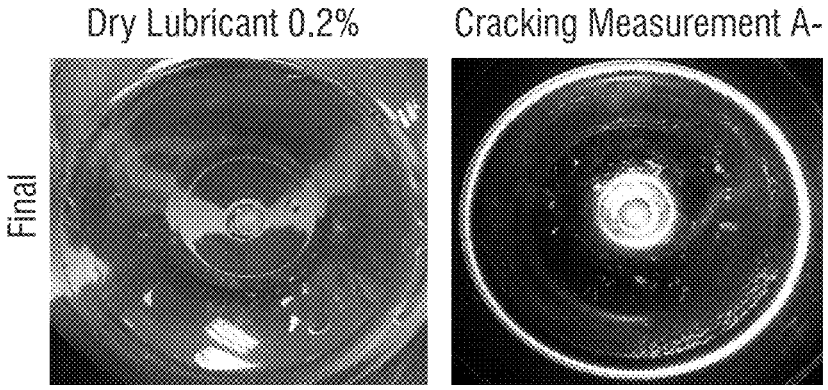

The results are shown in FIGS. 4A-B which demonstrate that a conveyor lubricant composition according to the present invention exhibited an advantageous low level of stress cracking in a standard test for compatibility with returnable PET bottles. FIG. 4A show the final measurements with the dry lubricant concentrate, and FIG. 4B show the final measurements with the dry lubricant 0.2%.

Table 4 provides further summary of the evaluation.

TABLE 4

| | Soft Water (Negative Control) | Dry Lubricant 0.2% solution | Dry Lubricant Concentrate | Observations |
|---|---|---|---|---|
| 7 days in direct contact | Without stress cracking formation | Light formation of stress cracking in the bottom of bottle | Formation of stress cracking in the bottom of bottle | No bottle breakage |
| 7 days subsequent storing at room temperature | Without stress cracking formation | No change in stress cracking formation | No change in stress cracking formation | No bottle breakage |
| Final Results | No cracking formation | A− | A+ | No bottle breakage |

The results show that overall the dry lubricant according to the invention provided excellent PET compatibility with returnable PET beverage bottles as well.

The inventions being thus described, it will be obvious that the same may be varied in many ways. Such variations are not to be regarded as a departure from the spirit and scope of the inventions and all such modifications are intended to be included within the scope of the following claims.

The above specification provides a description of the manufacture and use of the disclosed compositions and methods. Since many embodiments can be made without departing from the spirit and scope of the invention, the invention resides in the claims.

What is claimed is:

1. A dry lubricant composition comprising:

from about 1 wt-% to about 20 wt-% of one or more fatty acids;

from about 70 wt-% to about 85 wt-% of one or more hydrocarbons, wherein the one or more hydrocarbons have the general formula of $C_nH_{2n+2}$, $C_nH_{2n-2}$, $C_nH_{2n-6}$, or $C_nH_{2n}$;

from 0.1 wt-% to about 5 wt-% of one or more sorbitan esters;

from about 1 wt-% to about 5 wt-% of one or more nonionic surfactants; wherein the nonionic surfactants comprise an ethoxylated alcohol having from about 6 to about 24 carbon atoms and from about 3 to about 50 moles of ethylene oxide; and from about 0.001 wt-% to about 10 wt-% of one or more polyglycols;

wherein the composition is free of water and silicone.

2. The composition of claim 1, wherein the fatty acid is a fatty acid having between 6 to 22 carbon atoms.

3. The composition of claim 1, wherein the hydrocarbon is one or more of aliphatic hydrocarbons, benzene hydrocarbons, and mineral oil.

4. The composition of claim 1, wherein the sorbitan ester is sorbitan monooleate, sorbitan monolaurate, sorbitan monostearate, sorbitan tristearate, polyoxyethylene sorbitan trioleate, ethoxylated sorbitan monolaurate, or a combination thereof.

5. The composition of claim 1, wherein the one or more polyglycols are a polyalkylene glycol, polyethylene glycol, polypropylene glycol, or a combination thereof.

6. The composition of claim 1, wherein the fatty acid is oleic acid, wherein the sorbitan ester is sorbitan monooleate, wherein the hydrocarbon is a mineral oil, wherein the polyglycol is polyethylene glycol.

7. The composition of claim 1, further comprising an additional functional ingredient.

8. A dry lubricant composition comprising:

from about 1 wt-% to about 20 wt-% of a $C_6$-$C_{22}$ fatty acid;

from about 70 wt-% to about 85 wt-% of a mineral oil, wherein the mineral oil has a general formula of $C_nH_{2n+2}$, $C_nH_{2n-2}$, $C_nH_{2n-6}$, or $C_nH_{2n}$;

from about 0.1 wt-% to about 5 wt-% of sorbitan monooleate;

from about 0.001 wt-% to about 10 wt-% of one or more polyglycols; and from about 1 wt-% to about 5 wt-% of a nonionic surfactant; wherein the nonionic surfactant is an ethoxylated lauryl alcohol;

wherein the composition is free of water and silicone compounds.

9. A method of lubricating a surface comprising:

applying the lubricant composition of claim 1 to a surface in a dry mode application; and forming a lubricant layer or film on the surface while maintaining a coefficient of friction less than about 0.2 and thereby facilitating movement of one or more containers;

wherein the surface is a metal and/or plastic conveyor chain or a container in contact with the metal and/or plastic conveyor chain; and wherein the lubricant composition is applied undiluted.

10. The method of claim 9, wherein the conveyor chain is for moving bottled products.

11. The method of claim 9, wherein the application step is discontinuous.

12. The method of claim 9, wherein the application step is conducted using a spray or a nozzle.

13. The method of claim 12, wherein the nozzle contacts the lubricant composition with at least a portion of a container-contacting surface of the conveyor chain or at least a portion of a conveyor-contacting surface of the container.

14. The method of claim 13, wherein the composition is applied only to those portions of the conveyor chain that will contact the container, or only to those portions of the container that will contact the conveyor chain.

15. The method of claim 9, wherein the lubricant composition is applied for a period of time and not applied for a period of time and the ratio of applied:not applied time is at least 1:10.

16. The method of claim 9, wherein the lubricant composition is PET compatible as measured by a grade A or B in a stress cracking test for PET bottles, and wherein the container comprises polyethylene.

* * * * *